US010625990B2

(12) United States Patent
Henikl et al.

(10) Patent No.: US 10,625,990 B2
(45) Date of Patent: Apr. 21, 2020

(54) LARGE MANIPULATOR WITH ARTICULATED MAST THAT CAN BE QUICKLY FOLDED AND UNFOLDED

(71) Applicant: SCHWING GMBH, Herne (DE)

(72) Inventors: Johannes Henikl, Essen (DE); Wolfgang Kemmetmüller, Vienna (AT); Andreas Kugi, Vienna (AT); Reiner Vierkotten, Oberhausen (DE)

(73) Assignee: SCHWING GMBH, Herne (DE)

( * ) Notice: Subject to any disclaimer, the term of this patent is extended or adjusted under 35 U.S.C. 154(b) by 294 days.

(21) Appl. No.: 15/577,706

(22) PCT Filed: May 30, 2016

(86) PCT No.: PCT/EP2016/062183
§ 371 (c)(1),
(2) Date: Nov. 28, 2017

(87) PCT Pub. No.: WO2016/189169
PCT Pub. Date: Dec. 1, 2016

(65) Prior Publication Data

US 2018/0162701 A1 Jun. 14, 2018

(30) Foreign Application Priority Data

May 28, 2015 (DE) ..... 10 2015 108 473

(51) Int. Cl.
*B66C 13/18* (2006.01)
*B66C 13/20* (2006.01)
(Continued)

(52) U.S. Cl.
CPC ..... *B66C 13/20* (2013.01); *B66C 13/46* (2013.01); *E04G 21/04* (2013.01);
(Continued)

(58) Field of Classification Search
None
See application file for complete search history.

(56) References Cited

U.S. PATENT DOCUMENTS 6,140,787 A * 10/2000 Lokhorst ..... E02F 3/435 318/568.18
6,202,013 B1 * 3/2001 Anderson ..... B66C 13/40 701/50
(Continued)

FOREIGN PATENT DOCUMENTS

DE 69025471 T2 8/1996
DE 19933917 A1 2/2000
(Continued)

OTHER PUBLICATIONS

International Preliminary Report on Patentability issued in PCT/EP2016/062183, dated Dec. 7, 2017, 15 pages.
(Continued)

*Primary Examiner* — Jonathan M Dager
(74) *Attorney, Agent, or Firm* — Faegre Baker Daniels LLP

(57) ABSTRACT

The invention relates to a large manipulator (1), in particular a truck-mounted concrete pump, having a mast pedestal (3) which is rotatable about a vertical axis by means of a rotary drive and which is arranged on a chassis (2), having an articulated mast (4) which comprises two or more mast arms (5, 6, 7, 8), wherein the mast arms (5, 6, 7, 8) are connected, so as to be pivotable by means of in each case one pivoting drive, to the respectively adjacent mast pedestal (3) or mast arm (5, 6, 7, 8), having a control device, which actuates the drives, for the mast movement, and having a mast sensor arrangement for detecting the position of at least one point of the articulated mast (4) or a pivot angle ($\varphi_1$, $\varphi_2$, $\varphi_3$, $\varphi_4$) of at least one articulated joint. The large manipulator is characterized in that the control device (17) is designed to
(Continued)

limit the speed of the mast movement on the basis of the output signal from the mast sensor arrangement. The invention also relates to a method for controlling the movement of an articulated mast (4) of a large manipulator (1), in particular of a truck-mounted concrete pump.

18 Claims, 2 Drawing Sheets

(51) Int. Cl.
*B66C 13/46* (2006.01)
*E04G 21/04* (2006.01)

(52) U.S. Cl.
CPC ..... *E04G 21/0436* (2013.01); *E04G 21/0445* (2013.01); *E04G 21/0463* (2013.01)

(56) References Cited

U.S. PATENT DOCUMENTS 6,351,696 B1 * 2/2002 Krasny ..... E04G 21/0436 701/50
7,909,059 B2 * 3/2011 Wehner ..... B66C 23/78 137/615
8,135,518 B2 * 3/2012 Budde ..... E02F 9/265 701/50
8,505,184 B2 * 8/2013 Pirri ..... B66C 23/64 29/453
8,527,158 B2 * 9/2013 Faivre ..... E02F 9/265 37/411
8,857,567 B1 * 10/2014 Raymond ..... B66F 11/046 182/2.1
8,925,310 B2 * 1/2015 Pirri ..... E04G 21/0418 60/469
9,031,750 B2 * 5/2015 Miyoshi ..... B66C 23/701 701/50
9,068,366 B2 * 6/2015 Petzold ..... B66C 23/78
9,109,345 B2 * 8/2015 Okamura ..... E02F 9/2207
9,695,604 B2 * 7/2017 Trumper ..... E02F 9/123
9,752,298 B2 * 9/2017 Nakamura ..... E02F 9/26
9,783,952 B2 * 10/2017 Nagato ..... E02F 9/2285
9,810,242 B2 * 11/2017 Wang ..... F15B 21/008
10,046,955 B2 * 8/2018 Vierkotten ..... G01D 5/145
10,316,929 B2 * 6/2019 Wang ..... F16F 15/023
2003/0001751 A1 * 1/2003 Ogura ..... E02F 9/2296 340/691.6
2003/0066659 A1 * 4/2003 Bissen ..... A62C 31/24 169/47
2003/0196506 A1 * 10/2003 Rau ..... B66C 13/066 74/473.1
2004/0076503 A1 * 4/2004 Rau ..... B66C 13/40 414/699
2004/0228739 A1 * 11/2004 Mayer ..... E04G 21/04 417/231
2004/0267404 A1 * 12/2004 Danko ..... B25J 9/1607 700/245
2005/0004734 A1 * 1/2005 Cripps ..... E02F 3/435 701/50
2005/0049838 A1 * 3/2005 Danko ..... G06F 17/13 703/2
2005/0224439 A1 * 10/2005 Bean ..... B66F 11/046 212/280
2005/0278099 A1 * 12/2005 Benckert ..... B66C 13/40 701/50
2007/0168100 A1 * 7/2007 Danko ..... B25J 9/1628 701/50
2008/0217279 A1 * 9/2008 Gelies ..... B66C 13/40 212/278
2009/0204259 A1 * 8/2009 Danko ..... G05B 13/024 700/250
2010/0139792 A1 * 6/2010 Rau ..... B66C 1/44 137/615
2012/0173094 A1 * 7/2012 Steinich ..... B66C 23/78 701/50
2013/0253759 A1 * 9/2013 Matsumoto ..... B66C 23/905 701/31.1
2016/0076263 A1 * 3/2016 Tebeek ..... B66C 13/066 701/50
2016/0084270 A1 * 3/2016 Specks ..... E04G 21/0436 60/445
2016/0121481 A1 * 5/2016 Borroni ..... E04G 21/0463 700/256
2016/0176692 A1 * 6/2016 Sawodny ..... B66F 17/006 701/50
2016/0221189 A1 * 8/2016 Nilsson ..... B25J 9/1653
2016/0223313 A1 * 8/2016 Vierkotten ..... B66C 13/46
2017/0167149 A1 * 6/2017 Vierkotten ..... B66C 15/045
2017/0254101 A1 * 9/2017 Segschneider ..... B66C 23/64
2018/0037444 A1 * 2/2018 Henikl ..... B66C 13/066
2019/0119934 A1 * 4/2019 Vierkotten ..... E04G 21/0436

FOREIGN PATENT DOCUMENTS

DE 102013006232 A1 10/2014
EP 1939134 A2 7/2008
EP 2386387 A1 11/2011
EP 3015625 A1 5/2016
JP 2013091931 A 5/2013
WO WO02064912 A1 8/2002
WO 2014166637 A1 10/2014

OTHER PUBLICATIONS

International Search Report and Written Opinion issued in PCT/EP2016/062183, dated Sep. 16, 2016, 20 pages [with English translation].

* cited by examiner

LARGE MANIPULATOR WITH ARTICULATED MAST THAT CAN BE QUICKLY FOLDED AND UNFOLDED

CROSS-REFERENCE TO RELATED APPLICATION

This application claims priority to International Patent Application No. PCT/EP2016/062183, filed May 30, 2016, which claims the benefit of DE Application No. 10 2015 108 473.2, filed May 28, 2015, both of which are herein incorporated by reference in their entireties.

FIELD OF THE INVENTION

The invention relates to a large manipulator, in particular truck-mounted concrete pump, having a mast pedestal which is rotatable about a vertical axis by means of a rotary drive and which is arranged on a chassis, having an articulated mast which comprises two or more mast arms, wherein the mast arms are connected, so as to be pivotable by means of in each case one pivoting drive, to the respectively adjacent mast pedestal or mast arm, having a control device, which actuates the drives, for the mast movement, and having a mast sensor arrangement for detecting the position of at least one point of the articulated mast or a pivot angle of at least one articulated joint.

The invention also relates to a method for controlling the movement of an articulated mast of a large manipulator, in particular of a truck-mounted concrete pump.

BACKGROUND

Large manipulators are known in a multiplicity of embodiments from the prior art. A large manipulator with an articulated mast is disclosed for example by WO 2014/166637 A1.

As pivoting drives which are used for pivoting the mast arms about the articulated joints relative to the respectively adjacent mast arm or mast pedestal, use is typically made of hydraulic cylinders. These are actuated, by means of proportionally operating actuation valves, by an electronic control device for the purposes of making it possible to variably predefine the movement speed of the individual hydraulic cylinders. In the case of known large manipulators, the movement speed of the individual hydraulic cylinders is normally limited, because an excessively fast movement of the articulated mast poses a hazard to persons situated in the surroundings. To ensure operational safety, there are legal standards which specify the admissible maximum speed of the tip of the articulated mast.

In the prior art, the control valves of the hydraulic cylinders are actuated by means of a remote controller which is connected (wirelessly or by wires) to the control device. Alternatively, the control valves may (for example in an emergency mode) be controlled manually using hand levers. The control valves are in this case designed such that a particular position of an operating lever on the remote controller corresponds to a defined volume flow of the hydraulic fluid, that is to say a defined movement speed of the respective hydraulic cylinder, specifically regardless of the pressure conditions respectively prevailing in the hydraulic system. Here, the control valves are designed such that, when all joints are pivoted simultaneously with the maximum movement speed and the articulated masters in the fully straightened state, the permitted maximum speed of the mast tip is not reached. This design of the control valves has the disadvantage that the legally permitted scope for the movement speed of the mast tip is, in most practical cases, very poorly utilized. The above-discussed "worst case", in which all of the joints are moved with the maximum speed in the case of a fully straightened articulated mast, practically never occurs. The limitation of the movement speed therefore leads, in most cases, to a very slow mast movement. As a result, considerable time delays arise during the folding-out and folding-in of the articulated mast. This makes the operation thereof inefficient.

The abovementioned WO 2014/16637 A1 proposes a large manipulator in the case of which the control device provides a rapid traverse facility for the rotary drive of the mast pedestal in order to rotate the articulated mast into the desired working position with increased speed, wherein the rapid traverse facility can be selected only when the mast or jib is in the fully folded-together state. A single sensor which interacts with the control device is provided in the known large manipulator, wherein, by means of the sensor, it can be detected whether or not the articulated mast is in the fully folded-together state. The sensor outputs an enable signal to the control device as long as it is ensure that the articulated mast is folded together and thus has a minimum radius. In the state, the articulated mast can be rotated at increased speed.

SUMMARY

In the case of a large manipulator known from the document cited above, the admissible scope for the speed of the mast tip is still inadequately utilized. Only when the articulated mast is in the fully folded-together state is a rotational movement of the mast at increased speed possible. In all partially folded-out positions, however, the articulated mast is, as before, moved only with reduced movement speed correspondingly to the "worst case", specifically such that, regardless of the mast position, the legally admissible maximum speed of the mast tip is never exceeded. In most cases, therefore, the mast speed achieved still lies considerably below that which is legally admissible. As before, the folding-out and the folding-in of the articulated mast take too long.

Against this background, it is an object of the invention to provide an improved large manipulator. In particular, it is the intention for the articulated mast to be able to be moved from the fully folded-in state into this desired working position in a minimal length of time. Likewise, it is the intention for the articulated mast to be able to be transferred from the working position into the fully folded-in position in a minimal length of time. Furthermore, it is intention for the articulated mast, in the deployed state, to be movable quickly from one working position to another working position.

The invention achieves the object, proceeding from a large manipulator of the type mentioned in the introduction, in that the control devices designed to limit the speed of the mast movement on the basis of the output signal from the mast sensor arrangement.

In the method according to the invention, the pivot angle of at least one articulated joint of the articulated mast is detected by sensor means preferably over the entire pivoting range, and the speed of the mast movement is limited in a manner dependent on the present pivot angle. Alternatively, the position of a point of the mast is detected, for example the distance of said point to the mast pedestal, and the speed of the mast movement is limited on the basis of this by the control device such that a maximum admissible speed of said point, or else the speed of another point of the articulated mast derived therefrom, is not exceeded.

For an increase of the speed of the mast movement, it is sufficient merely to detect the pivot angle of one mast joint at all times. This is the case even under the assumption that the articulated joints whose pivot angles are not detected are in an adverse position with regard to the speed of the mast tip. By means of such a refinement, it is already possible to achieve an increase of the movement speed in relation to the prior art. It is however also possible for a mast sensor arrangement to be provided by means of which all pivot angles of the articulated joints are detected at all times. For example, the articulated mast may have an angle sensor at each articulated joint, which angle sensor detects the respective present pivot angle. The mast speed can be optimally limited in this way.

According to the invention, the control device processes the detected pivot angles and, from the positions of the mast joints and the movement speed is of the pivot drives, calculates in particular the resulting speed of the mast tip. On the basis of this calculation, it is impossible for the drives of the pivot joints to be actuated and the speed of at least one of the drives to be limited.

In a preferred embodiment of the invention, the control device is designed to actuate the individual drives proportionally in accordance with a movement command, wherein the movement command predefines the setpoint speeds of the drives. Here, the movement command arises for example from the signals of a remote controller which is used by an operator of the large manipulator for controlling the mast movement. The control device actuates the individual drives such that the respective movement speed corresponds to the setpoint speed in accordance with the movement command. Here, the control device can, as discussed above, determine the speed, which results from the movement command, the mast arm lengths and the present pivot angles, of the tip of the articulated mast. The control device can correspondingly reduce the speeds of the individual drives in relation to the movement command as soon as the speed of the tip exceeds a predefined limit value, which corresponds for example to a legally predefined maximum speed. Here, the control device is preferably designed to regulate the speed of the tip of the articulated mast by actuation of the drives to a value lower than or equal to the predefined limit value. In one possible embodiment, the control device reduces the speeds of all drives by the same factor in relation to the movement command, such that the speed of the tip of the articulated mast is always lower than or equal to the predefined limit value, specifically regardless of the present mast position, which results from the pivot angles, detected by sensor means, of the articulated joints.

In a further preferred embodiment, the control device is designed to derive the movement command, that is to say the setpoint speeds of the individual drives, from an operating signal which predefines the setpoint movement of the tip of the articulated mast. This is to be considered in conjunction with so-called Cartesian or cylindrical control of the articulated mast, in the case of which the operator, by means of the remote controller, does not predefine the movement speeds of the individual drives but rather directly controls the movement of the mast tip. From this operating signal, the control device of the large manipulator according to the invention can derive and regulate the setpoint speeds of the individual drives, and in so doing automatically ensure compliance with the speed limits of the mast movement in all mast positions. According to the invention, with this Cartesian or cylindrical control, higher speeds of the individual drives are permitted in relation to the prior art. This is advantageous in particular if the mast is situated in the vicinity of so-called singular positions, and which higher speeds of the individual drives are required for a precise implementation of the movement preset for the mast tip. This is the case, for example when the mast is in a fully straightened state, if the user predefines a movement of the mast tip in the case of which the horizontal spacing of the mast tip to the mast pedestal is to be decreased while simultaneously maintaining an unchanged height of the mast tip. The invention thus permits, in the vicinity of such singular positions, a major improvement in the behavior of the system with Cartesian or cylindrical mast control.

Owing to the high speeds of the mast movement that are made available by means of the invention, it is the case in an advantageous embodiment of the invention that the control device, taking into consideration the mast position and the mast speed, determines the kinetic energy during the mast movement and limits the mast speed through the control of the mast drives such that a maximum kinetic energy of the articulated mast during its movement is not exceeded. This measure serves to prevent mechanical overloading of the articulated mast in the event of an abrupt acceleration or deceleration of the mast movement.

Furthermore, in order to avoid mechanical overloading of the articulated mast, the control device may comprise ramp control for the speed, possibly in conjunction with vibration damping. In this way, the acceleration and braking of the articulated mast movement can be limited.

The invention thus makes it possible to permit higher movement speeds at individual articulated joints of the mast, such that the legally predefined scope for the mast speed can be better utilized in relation to the prior art. The detection of the mast position by sensor means, and the derivation of the mast kinematics from the pivot angles, in this case forms the basis of regulation of the movement speeds of the drives, with which compliance with the legal speed restriction is always ensured. At the same time, it is possible in most practical situations for the articulated mast to be moved much more quickly than in the case of the large manipulators known from the prior art. Major time advantages are thus achieved, during the folding-out and folding-in of the articulated mast, in relation to the previously known systems.

BRIEF DESCRIPTION OF THE DRAWINGS

Exemplary embodiments of the invention will be discussed in more detail below on the basis of the drawing, in which.

DETAILED DESCRIPTION

Figure 1:
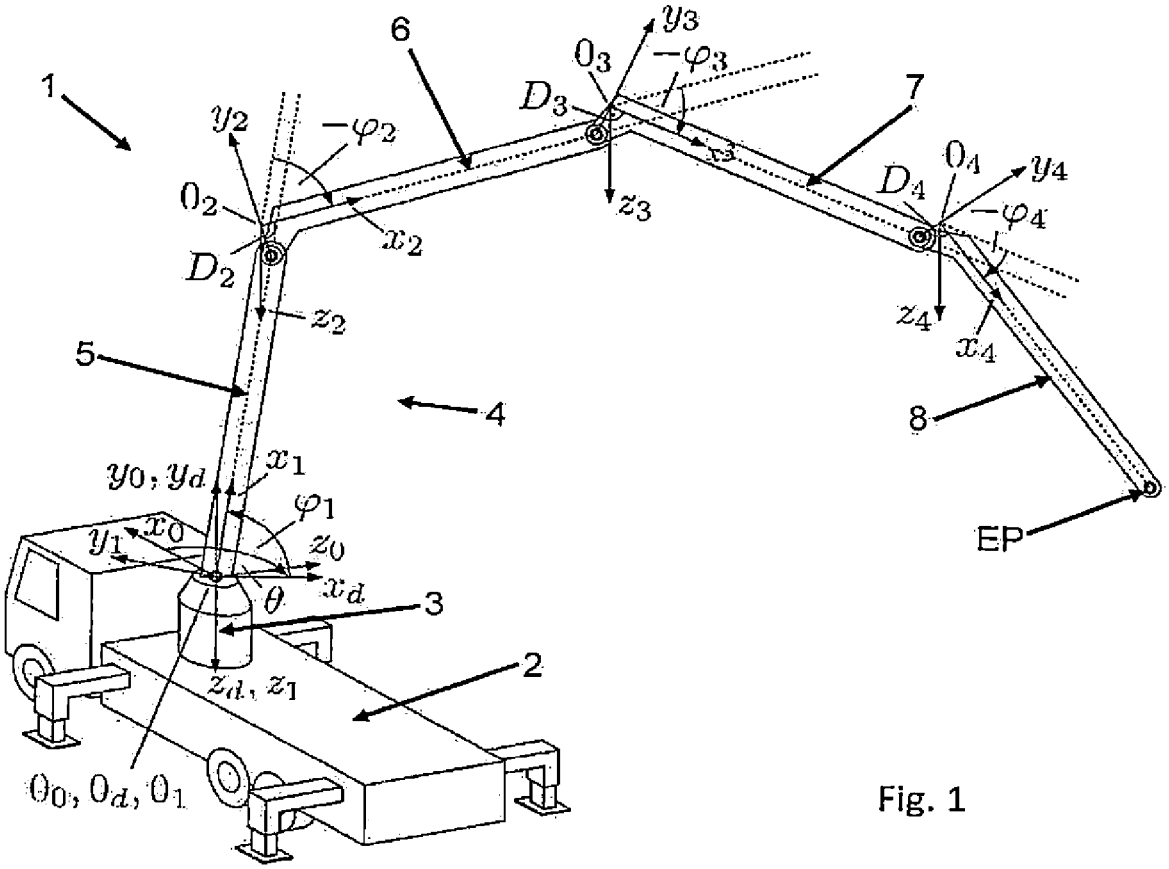
FIG. 1: shows a large manipulator according to the invention with articulated mast in one embodiment.

FIG. 1 schematically shows a large manipulator according to the invention, specifically a truck-mounted concrete pump, which is denoted overall by the reference designations 1. On a chassis 2 there is arranged a mast pedestal 3 which, by means of a rotary drive (not illustrated), is rotatable about a vertical axis of the truck-mounted concrete pump 1. On the mast pedestal 3 there is articulated an articulated mast denoted overall by the reference designations 4, which articulated mast comprises four mast arms 5, 6, 7 and 8 in the illustrated exemplary embodiment. The first mast arm 5 is attached to the mast pedestal 3 pivotably about a horizontal axis by means of a joint. The pivoting movement is effected by means of a pivot drive (for the sake of clarity, not illustrated). The remaining mast arms 6, 7 and 8 are connected to the respectively adjacent mast arms, pivotably about mutually parallel horizontal axes, by means of pivot joints. The pivoting movement is likewise effected in each case by a pivot drive (not illustrated). The pivot drives have in each case one (or more) hydraulic cylinders which are actuated by means of proportionally operating actuation valves. These in turn are controlled by an electronic control device (not illustrated) for the mast movement.

The large manipulator 1 according to the invention has a mast sensor arrangement (for example in the form of angle sensors for the joints, travel sensors for detecting the piston positions of the individual hydraulic cylinders, or geodetic inclination sensors). By means of the mast sensor arrangement, it is for example the case that the pivot angles $\varphi_1$, $\varphi_2$, $\varphi_3$ and $\varphi_4$ of the articulated joints are detected, wherein the control device, through corresponding actuation of the valves of the hydraulic cylinders, controls the speed of the mast movement in a manner dependent on the present pivot angles $\varphi_1$, $\varphi_2$, $\varphi_3$ and $\varphi_4$.

Below, an exemplary embodiment of an algorithm for the mast control according to the invention will be discussed in detail on the basis of a large manipulator which has an arbitrary number of N joints and which is anchored with the mast pedestal 3 at a fixed point on the chassis 2. FIG. 1 representatively shows the case of a truck-mounted concrete pump 1 with an articulated mast 4 which has N=4 joints. The elastic deformation of the individual mast arms 5, 6, 7, 8 is disregarded, such that these can be regarded as rigid bodies. For the determination of the speed of the end point EP of the articulated mast 4, the description of the kinematics of the system is necessary. The degrees of freedom of the system are the rigid body angles $\varphi_i$ for i=1, . . . , N and the angle of rotation 6 of the mast pedestal 3 about its vertical axis of rotation. The absolute movements of the system are described in the inertial coordinate system $0_0x_0y_0z_0$, that is to say in the coordinate system which is fixed relative to the chassis 2. $0_dx_dy_dz_d$ denotes the coordinate system which is rotated through the angle of rotation 6 relative to the inertial coordinate system. Furthermore, for each mast arm 5, 6, 7, 8, a local coordinate system $0_ix_iy_iz_i$ is defined whose $x_i$ runs along the longitudinal axis of the respective mast arm 5, 6, 7, 8. Since, for i≥2, the mast arms typically have a bend at the start, the longitudinal axis thereof does not intersect the respective joint axis. The origin of each local coordinate system is therefore laid through the point of intersection of the longitudinal axis with that orthogonal straight line which runs through the joint axis. The spacings between the joint axes and the origins of the local coordinate systems are denoted by $D_i$ for i=2, . . . , N.

The kinematic relationships between the local coordinate system and the inertial coordinate system can be represented using rotation matrices and translation vectors. The inertial coordinates of a point on the longitudinal axis of the i-th mast arm $r_i^i(x_i)=[x_i,0,0]^T$, described in the local coordinate system i (characterized by the lower index), are given by $$r_0^i(x_i)=R_0^i r_i^i(x_i)+d_0^i.$$

The matrix $$R_0^i = R_0^d R_d^1 R_1^2 \ldots R_{i-1}^i$$

where $$R_0^d = \begin{bmatrix} \cos(\theta) & 0 & -\sin(\theta) \\ 0 & 1 & 0 \\ \sin(\theta) & 0 & \cos(\theta) \end{bmatrix},$$

$$R_d^1 = \begin{bmatrix} \cos(\varphi_1) & -\sin(\varphi_1) & 0 \\ \sin(\varphi_1) & \cos(\varphi_1) & 0 \\ 0 & 0 & 1 \end{bmatrix}$$

and $$R_{j-1}^j = \begin{bmatrix} \cos(\varphi_j) & -\sin(\varphi_j) & 0 \\ \sin(\varphi_j) & \cos(\varphi_j) & 0 \\ 0 & 0 & 1 \end{bmatrix}$$

for j=2, . . . , N describes the rotational offset of the local coordinate system $0_ix_iy_iz_i$ with respect to the inertial coordinate system $0_0x_0y_0z_0$. The translational offset $d^i_0$ between the local coordinate system $0_ix_iy_iz_i$ and the inertial coordinate system $0_0x_0y_0z_0$ is given by $$d_0^j=R_0^{j-1}d_{j-1}^j+d_0^{j-1},$$

for j=2, . . . , N where $d^1_0=[0, 0, 0]^T$, and $$d_{j-1}^j = R_{j-1}^j \begin{bmatrix} 0 \\ D_j \\ 0 \end{bmatrix} + \begin{bmatrix} L_{j-1} \\ 0 \\ 0 \end{bmatrix}.$$

Here, $L_j$ denotes the length of the j-th mast arm.

The inertial coordinate of the end point EP of the N-th mast arm can thus be represented as a function of the positions of the N joints and of the mast pedestal 3 by $r_{0,N}^{EP}(q)=r_0^N(L^N)$ with the vector of the degrees of freedom $q=[\theta, \varphi_1, \ldots, \varphi_N]^T$. The speed of the end point EP in the direction of the individual coordinate axes is obtained, by differentiation with respect to time, as $$\dot{r}_{0,N}^{EP}(q) = \frac{\partial r_{0,N}^{EP}(q)}{\partial q}\dot{q} = J_{q,N}^{EP}\dot{q}.$$

By means of the hydraulic systems used, in combination with the control device, proportional control of the movement speeds of the individual hydraulic cylinders is made possible for the operator of the large manipulator according to the invention. The resulting joint angular speeds can, with knowledge of the transmission ratio of the joint kinematic arrangements, be determined on the basis of the setpoint speeds for the hydraulic cylinders. The piston position $s_{z,i}$ of a cylinder can be represented generally as a non-linear function of the corresponding joint angle $\varphi_i$, $$s_{z,i}=f_{z,i}(\varphi_i).$$

In the speed domain, the relationship $$\dot{s}_{z,i} = \frac{\partial f_{z,i}(\varphi_i)}{\partial \varphi_i}\dot{\varphi}_i$$

applies, whereby, from a predefined piston speed $\dot{s}_{z,i}^{d}$ the resulting joint angular speed can be determined. Furthermore, with this relationship, it is conversely possible, from a predefined joint angular speed, to calculate the corresponding piston speed. Uniform, proportional control of the joint angular speeds is thus made possible for the user. This is particularly advantageous for the user because, in this way, the generally unavoidable non-linearity of the joint kinematics is compensated. The vector $$\dot{q}=[\dot{\theta}^{d},\dot{\varphi}_1^{d},\ldots,\dot{\varphi}_N^{d}]^T$$

is therefore representative of the user inputs, that is to say the movement command within the meaning of the invention, which predefines the setpoint speeds of the drives or directly of the joints. According to the invention, the use of a suitable mast sensor arrangement is necessary for the detection of the joint positions or of the degrees of freedom q.

The absolute speed of the jib tip EP is given by $$v^{EP}=\sqrt{\dot{q}^{T}(J_{q,N}^{EP})^{T}J_{q,N}^{EP}\dot{q}}.$$

If this exceeds the maximum permitted speed $v^{EP}_{max}$, all speeds of the drives are, by means of the control device, reduced uniformly, that is to say by the same factor, in relation to the setpoint speed predefined by the movement command. A vector $\dot{q}_{red}$ is thus sought for which $$v_{max}^{EP}=\sqrt{\dot{q}^{T}_{red}(J_{q,N}^{EP})^{T}J_{q,N}^{EP}\dot{q}_{red}}.$$

applies. Owing to the demand for the uniform reduction of the speeds, this problem can be uniquely solved, and simplified to the determination of a factor $k_{red}\in\mathbb{R}$ where $\dot{q}_{red}=k_{red}\dot{q}$. Therefore, $$v_{max}^{EP}=\sqrt{k_{red}^{2}\dot{q}^{T}(J_{q,N}^{EP})^{T}J_{q,N}^{EP}\dot{q}}$$

applies, from which the relationship $$k_{red}=\frac{v_{max}^{EP}}{\sqrt{\dot{q}^{T}(J_{\dot{q},N}^{EP})^{T}J_{\dot{q},N}^{EP}\dot{q}}}$$

follows. The result for the modified movement command $\dot{q}_{red}$, that is to say with speeds reduced in relation to the operator preset $\dot{q}$, is finally $$\dot{q}_{red}=\frac{v_{max}^{EP}}{\sqrt{\dot{q}^{T}(J_{\dot{q},N}^{EP})^{T}J_{\dot{q},N}^{EP}\dot{q}}}\dot{q}.$$

The control device actuates the hydraulic cylinder in accordance with said modified movement command and limits the movement speed thereof, such that the mast tip EP never moves faster than is legally allowed. At the same time, in any arbitrary mast position, the movement speed can be the fastest possible within the legal scope, whereby a considerable length of time can be saved, in relation to the prior art, during the folding-out and folding-in of the articulated mast 4 and also during the movement of the mast between two working positions.

Figure 2:
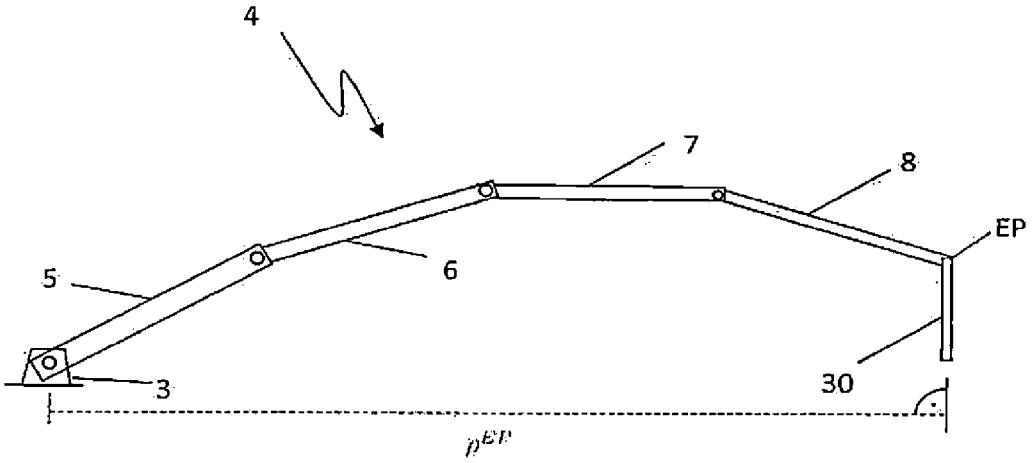
FIG. 2 shows an articulated mast of a large manipulator according to the invention in a further embodiment.

In a further embodiment of the invention, instead of the mast sensor arrangement for detecting the pivot angle, sensors for detecting the positions of the end points of the mast arms relative to the mast pedestal or chassis are proposed. These are generally known to a person skilled in the art and may for example be in the form of GPS, radio or ultrasound sensors. As shown in FIG. 2 for the position of the end point EP of the final mast element 8, is for example the case that the horizontal distance $\rho^{EP}$ (the radius) of the mast tip to the inertial coordinate system is detected by measurement. If it is sought to limit only the horizontal movement speed, independently of the movement presets for the individual cylinders, to a value $v_{max}^{EP}$, the result is the particularly simple requirement for compliance with the inequation $$\dot{\theta}^{d}\leq\frac{v_{max}^{EP}}{\rho^{EP}}.$$

It must furthermore be mentioned that, for the implementation of the invention, it is not necessary for all joint angles to be detected. For example, if the angle of the final joint $\varphi_N$ is not detected, the algorithm may be modified such that, instead of the speed of the mast tip, the speed of the end point $r_{0,N-1}^{EP}(q)$ of the penultimate mast segment with the index N−1 is monitored. In a manner dependent on the position thereof, a maximum admissible speed for said end point can be determined, in the case of compliance with which the maximum permitted speed of the mast tip cannot be exceeded regardless of the joint angle $\varphi_N$. With this limitation, too, a considerable time saving is possible, in relation to the prior art, during the deployment and retraction of the machine.

In the described approaches to a solution, it is to be noted that, owing to the higher movement speeds in the individual joints and in the rotary mechanism, abrupt braking of the hydraulic actuators at relatively high speeds and thus in the presence of relatively high kinetic energy inevitably leads to higher dynamic forces in relation to present systems. It must therefore be ensured that the higher dynamic forces do not cause the load limits of the mechanical components to be exceeded. Although abrupt braking should not occur during normal operation of the machine by means of corresponding operation by the technician this possibility must always be anticipated, for example in the context of an emergency stop.

To avoid high dynamic loads during normal operation, ramp control and system for active vibration damping are proposed. By means of active vibration damping, the dynamic load can be reduced because, in this way, occurring vibrations can be quickly eliminated. The first amplitude of a vibration caused by an abrupt movement change predefined by the user is substantially maintained even despite vibration damping, though can be reduced in an effective manner for example by means of ramp control. This may be implemented for example as an actuation rate limitation, in the case of which the magnitude of the rate of change of the speed setpoint values is limited to a maximum value. If $\dot{\varphi}_i^{d}(kT_a)$ and $\dot{\varphi}_i^{d}((k-1)T_a)$ denote the speed presets at the sampling times $t=kT_a$ and $t=(k-1)T_a$ with the sampling period $T_a$, the adjustment rate limitation can be described in the form $$\frac{|\dot{\varphi}_i^{d}(kT_a)-\dot{\varphi}_i^{d}((k-1)T_a|}{T_a}\leq R_{max},$$

with a maximum permitted adjustment rate $R_{max}$. A further embodiment of ramp control is a time-delayed first-order holding element. In the case of the latter, use is made of the fact that the setpoint speed $\dot{\varphi}_{i,B}^{d}$ predefined by the user is sampled with a slower time constant $T_B=v_T T_a$ for $v_T\gg 1$ and $v_T \varepsilon \mathbb{N}$. It is thus possible, between two user presets, to predefine a quasi-continuous profile of the actuation variable $\dot{\varphi}_{i,S}^{d}$. This profile is selected is a straight line in the implementation variant proposed here. If k denotes the sampling step for the sampling with the time constant $T_a$, and $\bar{k}$ denotes the sampling step for the sampling of the user preset with the time constant $T_B$, the resultant actuation signal can be represented by $$\dot{\varphi}_{i,S}^{d}(kT_a) = \dot{\varphi}_{i,B}^{d}((k-1)T_B) + \frac{\dot{\varphi}_{i,B}(\bar{k}T_B) - \dot{\varphi}_{i,B}((\bar{k}-1)T_B)}{T_B}(kT_a - (\bar{k}-1)T_B).$$

This approach has the advantage that, for the user, a uniform delay behavior of the system is realized for the entire actuation range.

Since the proposed ramp control and active vibration damping cannot be active in the event of an emergency stop of the machine, a further system may be provided in the case of which, in addition to the limitation of the speed of the mast tip, the kinetic energy of the jib resulting from the setpoint speeds is limited. If one considers the jib in simplified form as a rigid body system, the kinetic energy resulting from the movement presets can be represented by $$E_{kin} = \tfrac{1}{2}\dot{q}^T M(q)\dot{q}$$

with the generalized mass matrix M(q). The generalized mass matrix results from the present position of the mast and the mass distribution of the individual mast arms. It can be determined using the known methods in robotics for describing the dynamics of multi-body systems. If the resulting kinetic energy exceeds a maximum permitted value $E_{kin,max}$, for which for example the kinetic energy in the case of a straightened mast and a maximum speed of all joints can be selected, all user inputs are reduced uniformly by the system. A vector $\dot{q}_{red}$ is thus sought for which $$\tfrac{1}{2}\dot{q}_{red}^T M(q)\dot{q}_{red} = E_{kin,max}$$

applies. Owing to the demand for the uniform reduction of the speeds, this problem can be uniquely solved, and simplified to the determination of a factor $k_{red} \varepsilon \mathbb{R}$ where $\dot{q}_{red} = k_{red}\dot{q}$. Thus, $$k_{red}^2 \tfrac{1}{2}\dot{q}^T M(q)\dot{q} = E_{kin,max}$$

applies, from which the relationship $$k_{red} = \sqrt{\frac{E_{kin,max}}{\frac{1}{2}\dot{q}^T M(q)\dot{q}}}$$

follows. The result for the modified movement command $\dot{q}_{red}$, that is to say with reduced speeds in relation to the operator preset $\dot{q}$, is finally $$\dot{q}_{red} = \sqrt{\frac{E_{kin,max}}{\frac{1}{2}\dot{q}^T M(q)\dot{q}}}\,\dot{q}.$$

The maximum movement speeds resulting from the limitation of the kinetic energy are lower than those demanded by the standard. In the case of a folded-out mast 4 in typical positions on construction sites, there are thus only small resulting increases in the maximum speeds in relation to the prior art. However, when the mast is in a substantially folded-in state (the pivoting of the rotary mechanism in particular is time-critical during the deployment and retraction of the mast), much higher speeds are nevertheless possible. It is thus likewise possible to save a considerable length of time, in relation to the prior art, during the folding-out and folding-in of the articulated mast 4.

In the determination of the kinetic energy, it may furthermore be taken into consideration that, during the deployment and retraction of the concrete pump, no concrete is situated in the concrete delivery line, whereby higher movement speeds are made possible than during the concreting process, in which the concrete in the delivery line greatly increases the kinetic energy of the mast.

Figure 3:
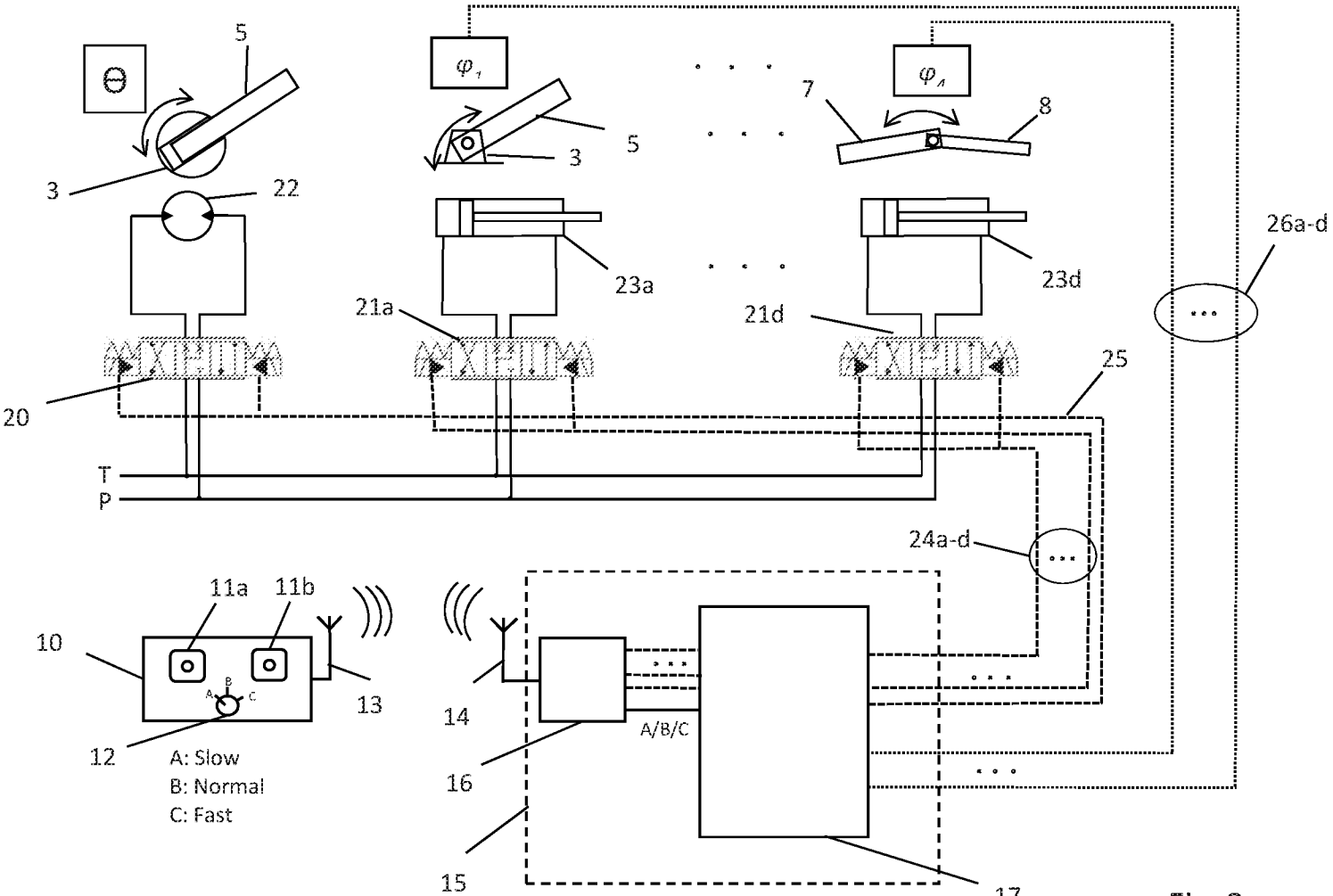
FIG. 3: shows a block circuit diagram of the control of the articulated mast of a large manipulator according to the invention.

FIG. 3 shows a block circuit diagram with an embodiment of the mast sensor arrangement for the actuation of the mast 4 of the large manipulator 1 according to the invention, in the case of which the control or limitation of the speed of the mast movement is performed in a manner dependent on the present mast position.

The articulated mast 4 is controlled from a remote controller 10 by an operator using the two joysticks 11*a* and 11*b*. The joystick 11*a* is used for example to control the rotary movement of the rotary drive of the articulated mast 4, and the joystick 11*b* is used for example to actuate the pivot drives of the individual articulated joints of the articulated mast 4. With the selector switch 12, the operator can select different movement speeds (A=slow speed; B=normal speed and C=high speed). The position A is selected in particular during the concreting process. Here, very low limit speeds are preset for the individual drives of the articulated mast 4. The position B corresponds to the simple control of the mast arm 4 as in the prior art. In position C, the mast speed is optimized, or maximized, in accordance with the invention.

The control signals of the joysticks 11*a*, 11*b* and the switching position of the rotary switch 12 are transmitted via a radio interface 13/14 to the mast controller 15 with processor 17. The processor 17 receives the output signals of the mast sensor arrangement via the signal lines 26*a-d*, which output signals correspond to the pivot angles $\varphi_1$ to $\varphi_4$ of the individual articulated joints of the articulated mast 4 or can be derived therefrom. The angles may for example be detected directly by means of rotational angle sensors, which may also operate contactlessly (for example in accordance with the Hall principle). The articulation angles of the articulated mast 4 may also be determined in the processor 17 on the basis of signals from geodetic inclination sensors which are attached to the individual mast arms 5-8.

As long as the rotary switch 12 is situated in the position B, the processor 17 will not take the pivot angles $\varphi_1$ to $\varphi_4$ into consideration in the control of the articulated mast 4, and will actuate the hydraulic valves 20 and 21*a-c* such that the predefinable movement speeds of the individual drives are limited to fixed values which ensure compliance with legal standards regardless of the present pivot angles, that is to say the articulated mast behaves as in the case of the control known from the prior art. The control signals from the processor 17 are transmitted via the control lines 24*a*-24*d* and 25 to the proportional hydraulic valves 20 and 21*a* to 21*d*, wherein the hydraulic valve 20 actuates for example a hydraulic motor 22, which sets the mast pedestal 3 in rotational movement, and the hydraulic valves 21*a*-21*d* actuate the hydraulic cylinders 23*a-d*, which effect the pivoting of the mast arms 5-8 of the articulated mast 4, possibly with the aid of suitable diverting levers.

If the rotary switch 12 is in the position C for optimized/maximized mast speed, the processor 17 determines the mast position of the articulated mast 4 on the basis of the determined pivot angles $\varphi_1$ to $\varphi_4$. Said processor then controls the movement of the articulated mast 4 by means of the hydraulic valves 20, 21*a*-21*d* such that the movement speed of the articulated mast 4 at the end point EP does not exceed a predefined speed of the end point EP.

Furthermore, from the mast position and the calculated mast speed, the processor 17 determines the kinetic energy of the mast 4 and takes this into consideration, as discussed above, in the actuation of the hydraulic valves 20, 21*a*-21*d*. In this way, a maximum permitted kinetic energy of the moving articulated mast 4 is not exceeded.

Furthermore, the processor 17 may use an algorithm for vibration damping, whereby vibrations of the articulated mast 4, for example during braking or during concreting work, are reduced. In this way, it is also possible in particular during the braking of the mast, as already discussed above, to reduce the load on the articulated mast 4. Furthermore, the processor 17 may provide ramp control, as described in detail further above, in the actuation of the articulated mast 4 during the acceleration and deceleration of the movement of the articulated mast 4. The ramp control further reduces the load on the articulated mast 4.

LIST OF REFERENCE DESIGNATIONS

1 Large manipulator/truck-mounted concrete pump
2 Chassis
3 Mast pedestal
4 Articulated mast
5, 6, 7, 8 First to fourth mast arms
10 Remote controller
11*a* Left-hand joystick for mast movement
11*b* Right-hand joystick for mast movement
12 Rotary switch for mast speed
13 Antenna for remote controller radio connection
14 Antenna for remote controller radio connection
15 Mast controller
16 RF input circuit
17 Mast controller processor
20 Hydraulic proportional valve for mast rotation
21*a*-21*d* Hydraulic proportional valves for drive of articulated joints
22 Hydraulic motor for rotary drive
23*a*-23*d* Mast cylinders
24*a*-*d* Actuation of hydraulic valves of articulated joints
25 Actuation of hydraulic valve of mast controller
26*a*-*d* Measurement signal lines for mast articulation angle
30 End hose
P Hydraulics supply line
T Hydraulics tank line
θ Angle of rotation
$\varphi_4$-$\varphi_4$ Pivot angles of the mast joints

The invention claimed is:

1. A large manipulator having a mast pedestal which is rotatable about a vertical axis by way of a rotary drive and which is arranged on a chassis, having an articulated mast which comprises two or more mast arms, wherein the mast arms are connected, so as to be pivotable by way of in each case one pivoting drive, to the respectively adjacent mast pedestal or mast arm, having a control device, which actuates the pivoting drives, for the mast movement, and having a mast sensor arrangement for detecting the position of at least one point of the articulated mast or a pivot angle of at least one articulated joint, characterized in that:

the control device is configured to:

limit the speed of the mast based on an output signal from the mast sensor arrangement; and determine the speed based on a movement command, lengths of the mast arms, and the detected pivot angles from the output signal of the mast sensor arrangement.

2. The large manipulator as claimed in claim 1, characterized in that the control device is configured to limit the speed of at least one of the pivoting drives.

3. The large manipulator as claimed in claim 1, characterized in that the control device is configured to limit the speed of a point of the articulated mast.

4. The large manipulator as claimed in claim 1, characterized in that the mast sensor arrangement detects relative position of the at least one point of the articulated mast relative to the mast pedestal.

5. The large manipulator as claimed in claim 1, characterized in that the control device is configured to actuate the individual pivoting drives proportionally in accordance with a movement command, wherein the movement command predefines setpoint speeds of the drives.

6. The large manipulator as claimed in claim 1, characterized in that the control device is configured to reduce speed presets of an individual pivoting drive in relation to the movement command as soon as the movement command would lead to an exceedance of the speed of a tip of the articulated mast beyond a predefined limit value and/or exceeds the limit value.

7. The large manipulator as claimed in claim 1, characterized in that the control device is configured to regulate the speed of a tip of the articulated mast by actuation of the pivoting drives to a value lower than or equal to a predefined limit value.

8. The large manipulator as claimed in claim 1, characterized in that the control device is configured to reduce the speeds of all the pivoting drives by the same factor in relation to the movement command, such that the speed of a tip of the articulated mast is lower than or equal to a predefined limit value.

9. The large manipulator as claimed in claim 1, characterized in that the control device is configured to derive the movement command from an operating signal which predefines setpoint movement of the tip of the articulated mast.

10. The large manipulator as claimed in claim 1, characterized in that the control device is configured to determine kinetic energy of the articulated mast and to limit the mast speed such that a maximum kinetic energy of the articulated mast is not exceeded during the movement thereof.

11. The large manipulator as claimed in claim 1, characterized in that the control device comprises ramp control.

12. A method for controlling movement of an articulated mast of a large manipulator, the method comprising:

detecting, by sensor means, pivot angles of at least one articulated joint of the articulated mast or position of at least one point of the articulated mast;

limiting the speed of the articulated mast based on signals of the sensor means; and reducing speed presets of the individual drives in relation to a movement command as soon as the movement command would lead to an exceedance of the speed of a tip of the articulated mast beyond a predefined limit value and/or exceeds the limit value.

13. The method as claimed in claim 12, characterized in that the individual drives of the articulated joints are controlled proportionally in accordance with the movement command, wherein the movement command predefines setpoint speeds of the individual drives.

14. The method as claimed in claim 12, characterized in that the speed of the tip of the articulated mast is determined from the movement command, lengths of mast arms of the articulated mast and the present pivot angles, and/or the position of at least one point of the articulated mast.

15. The method as claimed in claim 14, characterized in that the speed of the tip of the articulated mast is regulated by actuation of the individual drives to a value lower than or equal to the predefined limit value.

16. The method as claimed in claim 14, characterized in that the speeds of all individual drives are reduced by the same factor in relation to the movement command, such that the speed of the tip of the articulated mast is lower than or equal to the predefined limit value.

17. The method as claimed in claim 14, characterized in that the movement command is derived from an operating signal which predefines the setpoint movement of the tip of the articulated mast.

18. A large manipulator having a mast pedestal which is rotatable about a vertical axis by way of a rotary drive and which is arranged on a chassis, having an articulated mast which comprises two or more mast arms, wherein the mast arms are connected, so as to be pivotable by way of in each case one pivoting drive, to the respectively adjacent mast pedestal or mast arm, having a control device, which actuates the pivoting drives, for the mast movement, and having a mast sensor arrangement for detecting the position of at least one point of the articulated mast or a pivot angle of at least one articulated joint, characterized in that:

the control device is configured to:

limit the speed of the mast based on an output signal from the mast sensor arrangement; and regulate the speed of a tip of the articulated mast by actuation of the pivoting drives to a value lower than or equal to a predefined limit value.

* * * * *